US005348567A

United States Patent [19]

Chappell

[11] Patent Number: 5,348,567

[45] Date of Patent: Sep. 20, 1994

[54] DECONTAMINATION METHOD

[75] Inventor: David J. Chappell, Symington, Scotland

[73] Assignee: Clyde Shaw Limited, United Kingdom

[21] Appl. No.: 54,678

[22] Filed: Apr. 29, 1993

[30] Foreign Application Priority Data

Nov. 17, 1992 [GB] United Kingdom ..... 9224074.6

[51] Int. Cl.[5] ..... C22B 9/20; C22B 60/00

[52] U.S. Cl. ..... 75/10.66; 75/377; 75/393; 75/560; 588/201

[58] Field of Search ..... 75/393, 560, 10.66, 75/377; 588/201

[56] References Cited

U.S. PATENT DOCUMENTS

H970 10/1991 Snyder et al. ..... 75/393

FOREIGN PATENT DOCUMENTS 132522 7/1982 Japan .
063362 4/1983 Japan .
078729 5/1983 Japan .
150855 8/1983 Japan .
214284 11/1983 Japan .
1172508 7/1989 Japan .
2141866A 1/1985 United Kingdom .
2266002A 4/1993 United Kingdom .

*Primary Examiner*—Melvyn J. Andrews
*Attorney, Agent, or Firm*—Krass & Young

[57] ABSTRACT

A method for decontamination of steel components contaminated with radioactive material comprises the steps:

(a) providing a mass of material including:
  (i) a proportion of steel carrying radioactive material; and
  (ii) a mass of slag forming material;
(b) melting the mass of material, to provide a volume of molten steel and a volume of slag, the radioactive material originally present on the steel migrating to the slag; and
(c) separating the slag from the molten steel. The mass of slag forming material is selected to provide a predetermined concentration of radioactive material in the slag. The concentration may be selected to be sufficiently dilute to allow disposal of the slag without restriction.

11 Claims, No Drawings

DECONTAMINATION METHOD

FIELD OF THE INVENTION

This invention relates to a method of decontaminating material, and in particular, but not exclusively, to a method of decontaminating equipment, used in oil and gas exploration and production, contaminated by adhering naturally occurring radioactive material (N.O.R.M.) or low specific activity (L.S.A.) scale, by direct melting of components after calculated radiological assessment to ensure adequate controlled dilution and permanent entrapment of the radioactivity in the produced slag.

BACKGROUND OF THE INVENTION

Equipment used in hydrocarbon exploration and production activities, such as steel tubulars and valves, often becomes contaminated with scale formed by the deposition of dissolved mineral salts. The problem is particularly acute in more mature oilfields where water injection is used to sustain reservoir pressure. Although the scale primarily comprises carbonates and sulphates, particularly barium sulphate (Barytes), quantities of naturally occurring radioactivity are present in the scale, in the form of Radium$^{228}$ and Actinium$^{226}$ and their daughters.

When scale contaminated components are taken out of use the radioactive scale is removed before disposal, for example, in the United Kingdom the requirements of the Radioactive Substances Act 1960 having to be met. At present the scale is removed by high pressure water jetting. This is a difficult and awkward procedure, as the scale builds up on interior surfaces and gaining entry to the interior of, for example, a valve body can be particularly difficult. Further, the scale which is removed is subject to handling and disposal restrictions. scale, typically, has an activity level of around 50 Bq/g (Becquerels per gram). Currently, in the United Kingdom, the scale removed from the components is either discharged into the sea or is treated and concentrated for long term safe storage. Increasingly stringent environmental controls limit, and may eventually prohibit, the disposal of such scale by discharging into the sea, and long term safe storage is expensive and likely to be unpopular with local residents and authorities.

A method of decontaminating radioactively contaminated scrap iron and/or steel is described in UK Patent Application No. 2 141 866 A. The method is concerned with the decontamination of material which is contaminated radioactively on the surface, such as is obtained from nuclear fuel reprocessing plants. The iron or steel is smelted in the presence of slagging agents, inactive isotopes of the radioactive elements present in the melt being added and subjected to the smelting process. It is said that the radioactive isotopes of the elements are driven out of the melt and are collected in the slag, resulting in a steel melt having a practically negligible radioactivity. The resulting radioactive slag is processed into refuse packs and which may be held in containers produced from the decontaminated iron or steel.

A further method of decontaminating molten steel is disclosed in Japanese Patent Application No. JP 1172508.

SUMMARY OF THE INVENTION

According to one aspect of the present invention, there is provided a method for decontamination of steel components carrying radioactive material, the method comprising melting a mass of material, including a proportion of contaminated steel and slag forming material, to form a volume of molten steel and a volume of slag, wherein the radioactive material originally present on the steel migrates to the slag which is then separated from the steel, the mass of slag forming material provided being controlled to provide a predetermined concentration of radioactive material in the slag.

Thus, once the slag is drawn off, the remaining steel is substantially free of the radioactive material and may be utilised subsequently without restriction.

The method of the invention may be advantageously applied to the decontamination of steel components contaminated with naturally occurring radioactive material (N.O.R.M.) or low specific activity (L.S.A.) radioactive scale, wherein the radioactive material originally present in the scale migrates to the slag.

It is preferred that the mass of material includes a predetermined amount of slag forming material and that the total radioactivity of the scale contaminated steel is known, such that the concentration of radioactive material in the resulting slag may be accurately estimated. Preferably, the level of radioactivity of the slag is selected to be sufficiently low to permit handling and disposal of the slag without restriction. In the United Kingdom, for example, the slag should preferably exhibit a level of radioactivity which allows exemption from the Radioactive Substances Act 1960, or within the higher level of activity specified by The Radioactive Substances (Phosphatic Substances, Rare Earths etc) Exemption Order 1962 made under that Act, which order specifies an upper activity limit of 14.8 Bq/g.

Determination of the degree of radiological contamination of the scale contaminated steel is required if the level of radioactivity in the resulting slag is to be predicted with accuracy. Accordingly, in a preferred aspect of the present invention, an initial determination of the radiological contamination of a batch of contaminated steel is established by carrying out the method of the invention in respect of a sample of the contaminated steel, measurement of the radioactivity of resulting slag determining the degree of contamination of the original sample. The result may then be applied as a fairly accurate representation of the general level of contamination of the batch of steel from which the sample was taken.

Preferably, melting of the larger batch takes place in a furnace which tends to produce a relatively large volume of slag, such as an electric arc furnace. The melting of the sample may be carried out in any small furnace in which the danger from radiological contamination is minimal, such as an induction furnace.

Preferably also, the mass of material to be melted includes a large proportion of uncontaminated scrap steel.

EXAMPLE

It was proposed to dispose of approximately 24000 kg of L.S.A. contaminated tubulars by direct melting in a 25 tonne electric arc furnace. Although the amount of scale present on the tubulars was small and of very low activity, typically 1.5 Bq/g Radium$^{226}$ and Actinium$^{228}$, it was not possible to determine the total weight of scale accurately by visual examination owing to internal pitting. An accurate estimate was necessary to determine the radiological loading to the arc furnace; an induction furnace melt will provide this information with insignificant radiological risks.

1.0 ACTIVITY DETERMINATION

The activity determination was carried out in a 1.5 tonne electric induction furnace.

Two 40 foot 7 inch diameter tubulars were cut into approximately 3 foot lengths. The furnace was charged initially with 100kg of dry scrap and the cut tubulars added as the melt progressed over a period of approximately one hour.

As an induction furnace melt produces little slag, 10 kg of Barium Sulphate was also added at the start of the melt to produce an adequate volume of slag for analytical purposes. All furnace inputs were weighed and samples of metal and slag were taken at the end of the melt for radiological analysis.

At the end of the melt, the slag was removed from the surface of the metal, allowed to cool and weighed.

1.1 RESULTS OF INDUCTION FURNACE MELT

FURNACE LOADING a) 100 kg Dry Scrap
b) 10 kg Barytes
c) 1020 kg 7" diameter contaminated tubular
Total Weight 1130 kg.

Total slag recovered 18 kg: % Slag/Metal 1.6%: Slag/Metal Ratio 1:63.

1.2 RADIOLOGICAL ANALYSIS

| | |
|---|---|
| Slag | |
| Radium 226 | 0.38 Bq/g |
| Actinium 228 | 0.36 Bq/g |
| Metal | |
| Radium 226 | 0.008 Bq/g |
| Actinium 226 | 0.004 Bq/g |

Average slag activity is 0.37 Bq/g, therefore, if the average activity of the original material was 1.5 Bq/g (scale) the amount of activity in the scale present in 1020 kg of tubular is:

$$\frac{18 \times 0.37}{1.5} = 4.44 \text{ kg}$$

As one tubular weighs 529 kg the weight of scale in a single tubular at 1.5 Bq/g is:

$$4.44 \times \frac{529}{1020} = 2.3 \text{ kg}$$

1.3 RADIOLOGICAL ASSESSMENT

| | |
|---|---|
| Slag (18 kg) | |
| Radium$^{226}$ | 18000 g × 0.38 Bq = 6840 Bq |
| Actinium$^{228}$ | 18000 g × 0.36 Bq = 6840 Bq |
| Metal (1112 kg) | |
| Radium$^{226}$ | 1112000 g × 0.008 Bq = 8896 Bq |
| Actinium$^{228}$ | 1112000 g × 0.004 Bq = 4448 Bq |

Therefore, total activity input from 1020 g of tubular:

| | |
|---|---|
| Radium 226 | 6840 + 8896 = 15736 Bq |

-continued

| | |
|---|---|
| Actinium 228 | 6480 + 4448 = 10298 Bq |

This assumes that the radiological analysis is clear of any background radiation and in the case of the metal analysis has the degree of accuracy stated in this very low level of activity.

In 1000 kg of tubular the activity present will be:

$$\text{Radium}^{226}\ \frac{1000}{1020} \times 15428\ Bq = 15.4\ kBq$$

$$\text{Actinium}^{228}\ \frac{1000}{1020} \times 10096\ Bq = 10.1\ kBq$$

2.0 FULL SCALE MELT

A 25 tonne electric arc furnace was charged with 12900 kg of 7" diameter L.S.A. contaminated production tubular together with 12800 kg of normal mild steel feedstock making a total charge of 25800 kg of feedstock. Initially, two pans of lime (185 kg each) were placed in the furnace, and after the initial full slag removal two further pans of lime, of the same weight, and a standard bag of fluorspar were added to the melt to assist in forming the refining slag.

Samples of slag and metal were taken at initial melt down and at a full slag removal. A sample of the refining slag and the exhaust dust from the dust extraction system together with melt shop dust samples were also collected.

At the end of the melt and after refining, slag weights were taken while dust emissions were estimated.

2.1 RADIOLOGICAL INPUT/OUTPUT

INPUT

The results of the induction furnace melt indicated that the activity of the tubulars melted averaged:

| | |
|---|---|
| Radium 226 | 15.4 Bq per 1000 kg |
| Actinium 228 | 10.1 Bq per 1000 kg |

On this basis the estimated full scale melt activity addition would have been:

| | |
|---|---|
| Radium 226 | 12.9 × 15.4 = 198.66 kBq |
| Actinium 228 | 12.9 × 10.1 = 130.29 kBq |

The estimated percentage of Actinium$^{228}$ to Radium$^{226}$ was 66%.

| OUTPUT | |
|---|---|
| Main Slag offtake (slag pot) | 1200 kg |
| Nuclide bearing dust | 20 kg |
| Secondary refining slag | 90 kg |
| Total: | 1310 kg |

Based on slag analysis the average activity of the slag was 0.15 Bq/g Radium$^{226}$ and 0.105 Bq/g Actinium$^{228}$. Thus the total Radium and Actinium outputs are:

| | |
|---|---|
| Radium$^{226}$ | 1310 kg × 0.15 Bq/g = 197 kBq |
| Actinium$^{228}$ | 1310 kg × 0.105 Bq/g = 138 kBq |

Thus, the estimated recovery rates for the two nuclides are respectively:

| | |
|---|---|
| Radium 226 | 99.5% |
| Actinium 228 | 106.1% |

The estimate output percentage of Actinium$^{228}$ to Radium$^{226}$ is 70%, as opposed to an estimated input percentage of 66%.

All the above figures are within the confidence limits of weight, mass and radiological verification.

Obviously, on a large scale process such as this, measurement deviation is inevitable but it is quite apparent that the vast majority of the radioactive input material is present in the offtake slag.

Analysis of the metal samples show Radium$^{226}$ activity averaging 0.008 Bq/g and Actinium$^{228}$ activity averaging 0.0045 Bq/g. In a 25,000 kg metal output this will amount to approximately 200 kBq Radium$^{226}$ and 112.5 kBq Actinium$^{228}$ respectively.

Analysis carried out on metal samples processed prior to any L.S.A. scale melting gave average readings of 0.02 Bq/g Radium$^{226}$ and 0.01 Bq/g Actinium$^{228}$ respectively. No other isotopes in these decay chains were discernible either from these samples of from metal samples taken after the test melts.

Although the above example relates to tubulars contaminated with only a small amount of scale of low activity, it is clear that the same method could be applied to highly contaminated steel components and, with controlled dilution of the contaminated feedstock with normal feedstock and the addition of predetermined volumes of slag forming material, uncontaminated steel may be produced together with a volume of slag of predictable activity, input quantities of each material being balanced to produce slag that may be handled and disposed of with minimal or no restrictions.

Although the above described example relates only to the disposal of L.S.A. contaminated steel tubulars, it will be clear to those of skill in the art that the method of invention may be applied to a wide range of contaminated components of different metallurgical composition and origins.

I claim:

1. A method for decontamination of steel components contaminated with radioactive material, the method comprising the steps:

(a) providing a mass of material including:

(i) a proportion of steel components contaminated by one of adhering naturally occurring radioactive material (N.O.R.M.) and low specific activity (L.S.A.) scale; and (ii) a mass of slag forming material;

(b) melting said mass of material, to provide a volume of molten steel and a volume of slag, the radioactive material originally present in the adhering (N.O.R.M.) and L.S.A. scale on the steel migrating to the slag; and (c) separating said slag from the molten steel, wherein said mass of slag forming material is selected to provide a predetermined concentration of radioactive material in said slag.

2. The method of claim 1, wherein the concentration of radioactive material in said slag is predetermined through the steps of:

(a) determining the total radioactivity of said proportion of steel carrying radioactive material; and (b) providing a mass of slag forming material necessary to achieve said predetermined concentration of radioactive material in said slag.

3. The method of claim 2, wherein said predetermined concentration of radioactive material in said slag is selected to be sufficiently dilute to permit handling and disposal of said slag without restriction.

4. The method of claim 2, wherein said total radioactivity of a selected batch of steel carrying radioactive material is determined by: melting a relatively small mass of material, including a sample of steel of known mass taken from said batch, to form a volume of molten steel and a volume of slag; measuring the radioactivity of the slag; and extrapolating the measured radioactivity to calculate the total radioactivity of said batch.

5. The method of claim 4, wherein melting of said sample is carried out in a relatively small furnace in which the danger from radiological contamination is minimal.

6. The method of claim 5, wherein melting of said sample is carried out in an electric arc furnace.

7. The method of claim 4, wherein melting of said batch takes place in a furnace which tends to produce a relatively large volume of slag.

8. The method of claim 7, wherein melting of said batch takes place in an electric arc furnace.

9. The method of claim 1, wherein the mass of material includes a proportion of uncontaminated scrap steel.

10. A method of decontaminating steel components, the method comprising the steps of:

(a) melting a mass of material including:

(i) a proportion of steel components contaminated by one of adhering naturally occurring radioactive material (N.O.R.M.) and low specific activity (L.S.A.) scale the steel components being of known total radioactivity; and (ii) a mass of slag forming material;

(b) melting said mass of material to provide a volume of molten steel and volume of slag, the N.O.R.M. and L.S.A. scale migrating to said slag; and (c) separating said slag from said molten steel, wherein said mass of slag forming material is selected to provide a predetermined dilution of N.O.R.M. and L.S.A. scale in said slag.

11. A method for decontamination of steel components contaminated with radioactive material, the method comprising the steps:

(a) providing a mass of material including:

(i) a proportion of steel carrying radioactive material; and (ii) a mass of slag forming material;

(b) determining the total radioactivity of said proportion of steel carrying radioactive material;

(c) melting said mass of material, to provide a volume of molten steel and a volume of slag, the radioactive material originally present on the steel migrating to the slag; and (d) separating said slag from the molten steel, wherein said mass of slag forming material is selected to provide a predetermined concentration of radioactive material in said slag that is sufficiently dilute to permit handling and disposal of said slag without restriction.

* * * * *